United States Patent [19]

Johnson, III et al.

[11] Patent Number: 4,580,636

[45] Date of Patent: Apr. 8, 1986

[54] FLOW LINE PULL IN TOOL

[75] Inventors: Rush L. Johnson, III, Cypress; Paul C. Berner, Houston, both of Tex.

[73] Assignee: Vetco Offshore, Inc., Ventura, Calif.

[21] Appl. No.: 604,802

[22] Filed: Apr. 27, 1984

[51] Int. Cl.[4] ..... E21B 43/013

[52] U.S. Cl. ..... 166/343; 166/347; 405/169

[58] Field of Search ..... 166/343, 347, 362, 344; 405/169

[56] References Cited

U.S. PATENT DOCUMENTS

| | | | |
|---|---|---|---|
| 3,308,881 | 3/1967 | Chan et al. | 166/343 |
| 3,690,112 | 9/1972 | Pattison et al. | 405/169 |
| 3,716,100 | 2/1973 | Nelson | 166/347 |
| 3,973,625 | 8/1976 | Baugh | 166/343 |
| 4,161,367 | 7/1979 | Cuiper et al. | 166/343 X |
| 4,457,378 | 7/1984 | Watkins | 166/347 |
| 4,459,065 | 7/1984 | Morton | 166/343 X |

FOREIGN PATENT DOCUMENTS

| | | | |
|---|---|---|---|
| 2038973 | 7/1980 | United Kingdom | 405/169 |

*Primary Examiner*—James A. Leppink
*Assistant Examiner*—Hoang C. Dang
*Attorney, Agent, or Firm*—Edward L. Kochey, Jr.

[57] ABSTRACT

A pull in tool incorporating within its structure a winch 220 and a capstan 210. A track system 231 on the tool moves to engage openings 38 in the guidelineless reentry assembly 50. Thereafter the flow line termination 400 is passed down the track system 231 to achieve precise final positioning.

6 Claims, 16 Drawing Figures

FLOW LINE PULL IN TOOL

BACKGROUND OF THE INVENTION

This invention relates to subsea wells and in particular to a method and apparatus for pulling in flow lines to the wellhead.

Offshore wells may be drilled hundreds and thousands of feet below the surface. When the well is to be produced a flow line must be pulled in and prepared for connection to a later installed production tree. These flow lines are pulled in and secured at a precisely predetermined location, so that when the production tree is installed it may be connected to both the wellhead and the flow line termination, whereby flow may be controlled and directed from the well to the flow line.

Typical systems for pulling in and connecting the flow lines are shown in U.S. Pat. Nos. 4,161,367, 3,866,677 and 4,382,717. In these the cable is passed through a pulley arrangement and attached to a bullnose at the end of the pipe to be pulled in. One end of the cable remains at the surface with the pull in tool being passed down to the wellhead. Tension is then applied at the surface to pull the flow line into the wellhead location.

Particularly, when dealing with deep wellheads, in the order of 7500 feet, this requires a long length of cable in the order of 9 to 10 thousand feet. This long cable has a potential for tangling. It also has considerable weight which must be handled and a considerable length of high strength cable, which must be stored on the floating vessel. The pull in system also has a poor response time because of the elasticity of the long length of pull in cable. Furthermore, emergency disconnect requires cutting of the cable and significant problems in reestablishing the pull in.

SUMMARY OF THE INVENTION

The pull in tool incorporates within its structure a winch and a capstan so that only the power supply in the form of hydraulic fluid or electrical power need be passed down to the pull in tool. The pull in cable, accordingly, need be only of a length sufficient to extend from the pull in tool to the end of the flow line rather than from the vessel to the sea bed in addition to the distance to the flow line.

Furthermore, a track assembly on the pull in tool is movable to engage openings in the guidelineless reentry assembly in a manner whereby there are low loads on the track assembly while it is engaging these openings. Thereafter, the flow line termination is passed down the track assembly to achieve the precise alignment required for the final connection.

DESCRIPTION OF THE PREFERRED EMBODIMENT

Figure 2:
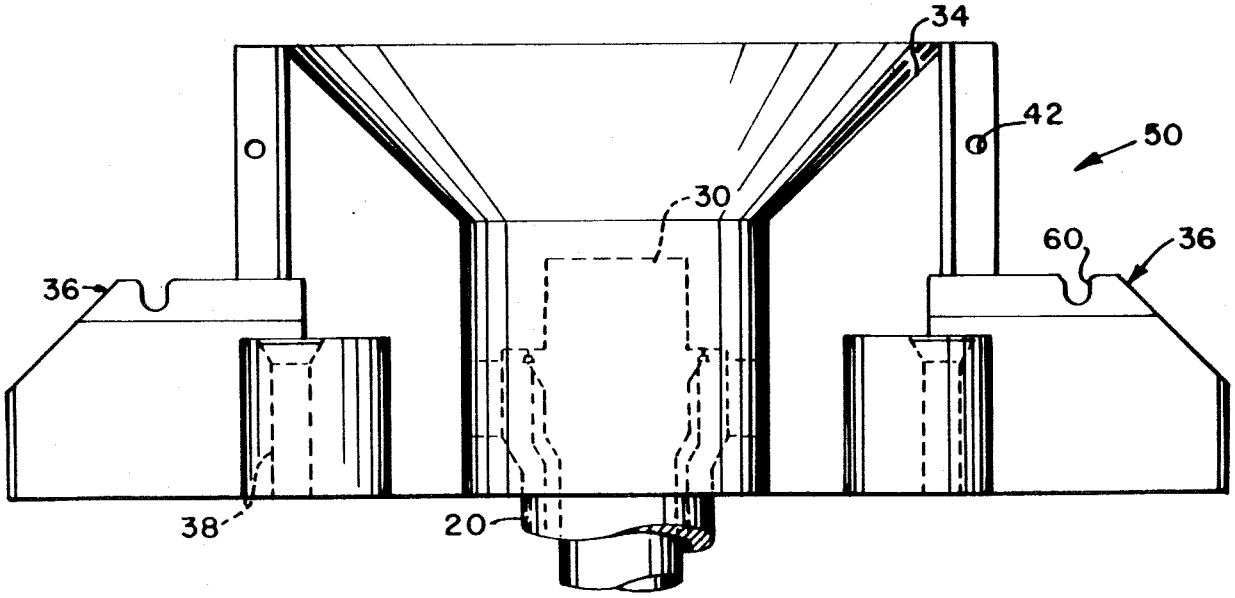
FIG. 2 is a side elevation of the guidelineless reentry assembly.
Figure 4A:
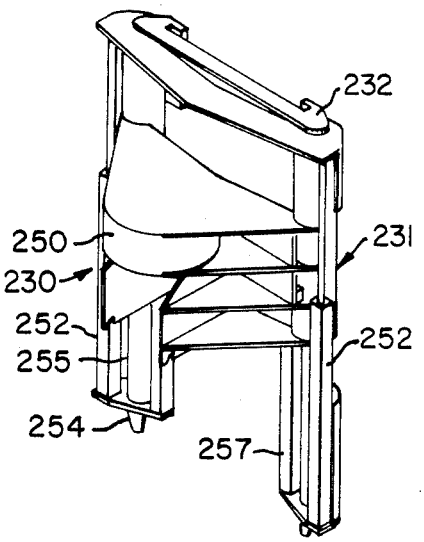
FIG. 4A shows the carriage and track assembly carried on the inner cage.
Figure 14:
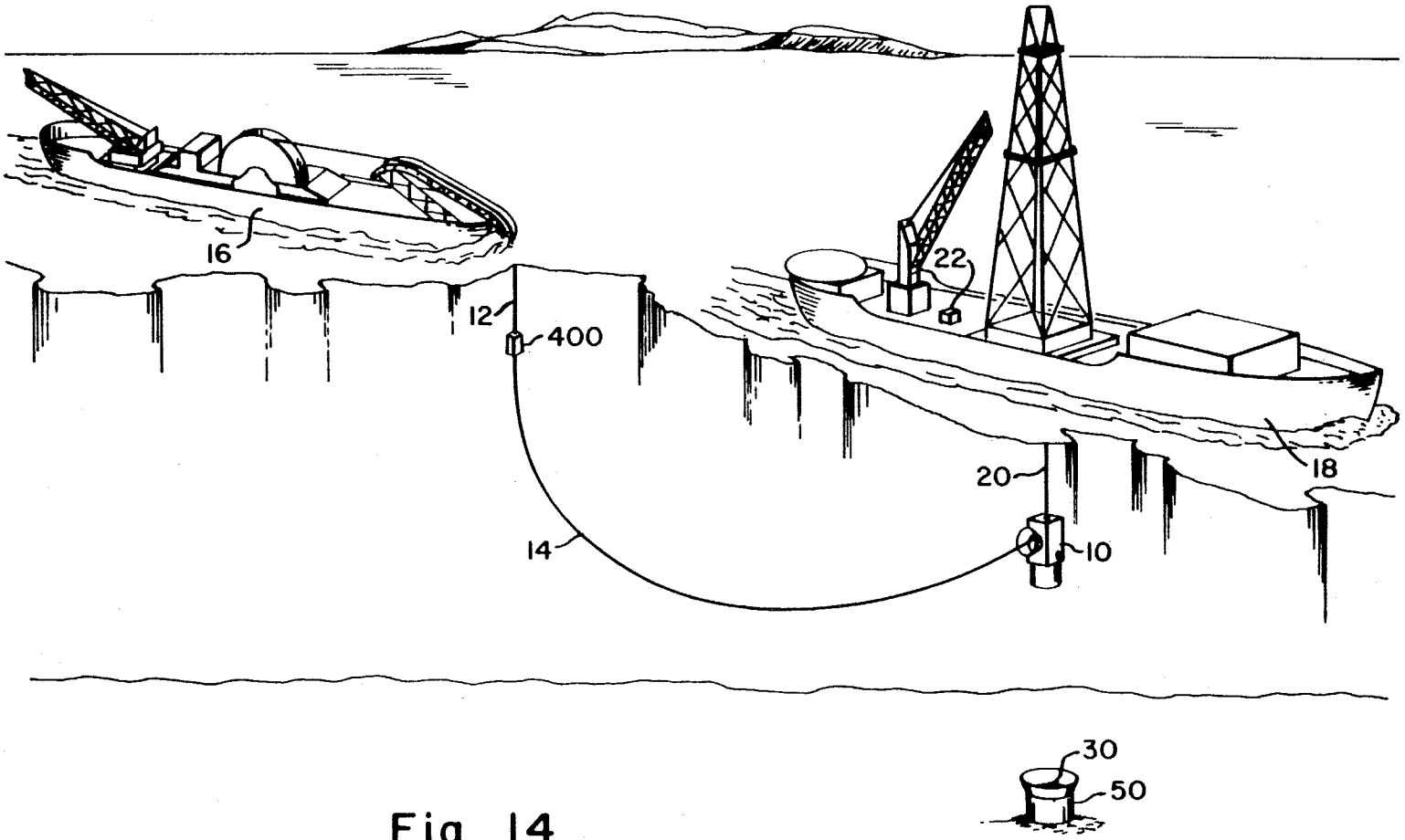
FIG. 14 is a general view at the pull in operation.

Referring to FIGS. 2 and 14, a permanent guide base in the form of a guidelineless reentry assembly 50 (hereinafter referred to as GRA) has been installed in a conventional manner. The GRA was secured to a 30 inch casing 20 which was cemented in place. A wellhead 30 has been landed and locked in place. By use of a pull in tool 10, flow line 12 is to be secured to the GRA 50. To accomplish this, a pull in cable 14 has been passed from the pipe laying barge 16 to the drill ship 18. The cable is attached to the flow line termination 400 on the pipe laying barge, and attached to the pull in tool on the drill ship.

The reentry system illustrated is a guidelineless reentry system such as illustrated in U.S. Pat. No. 4,167,215, which does not require guidelines for guiding apparatus to the GRA 50. The beginning of the operation is best shown in FIG. 14, wherein the pull in tool 10 is lowered on drill pipe 20 with a flow line 12 simultaneously being lowered by the pipe laying barge.

Figure 13:
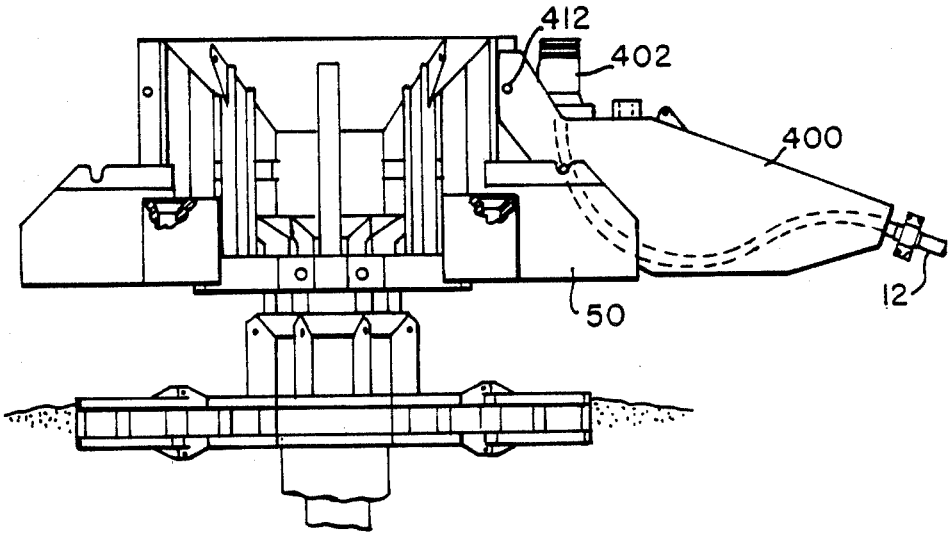
FIG. 13 shows the flow line connection complete with the pull in tool removed.

FIG. 13 illustrates the final result with the end 402 of the flow line 12 being secured in a predetermined spaced relationship from the wellhead.

Figure 1:
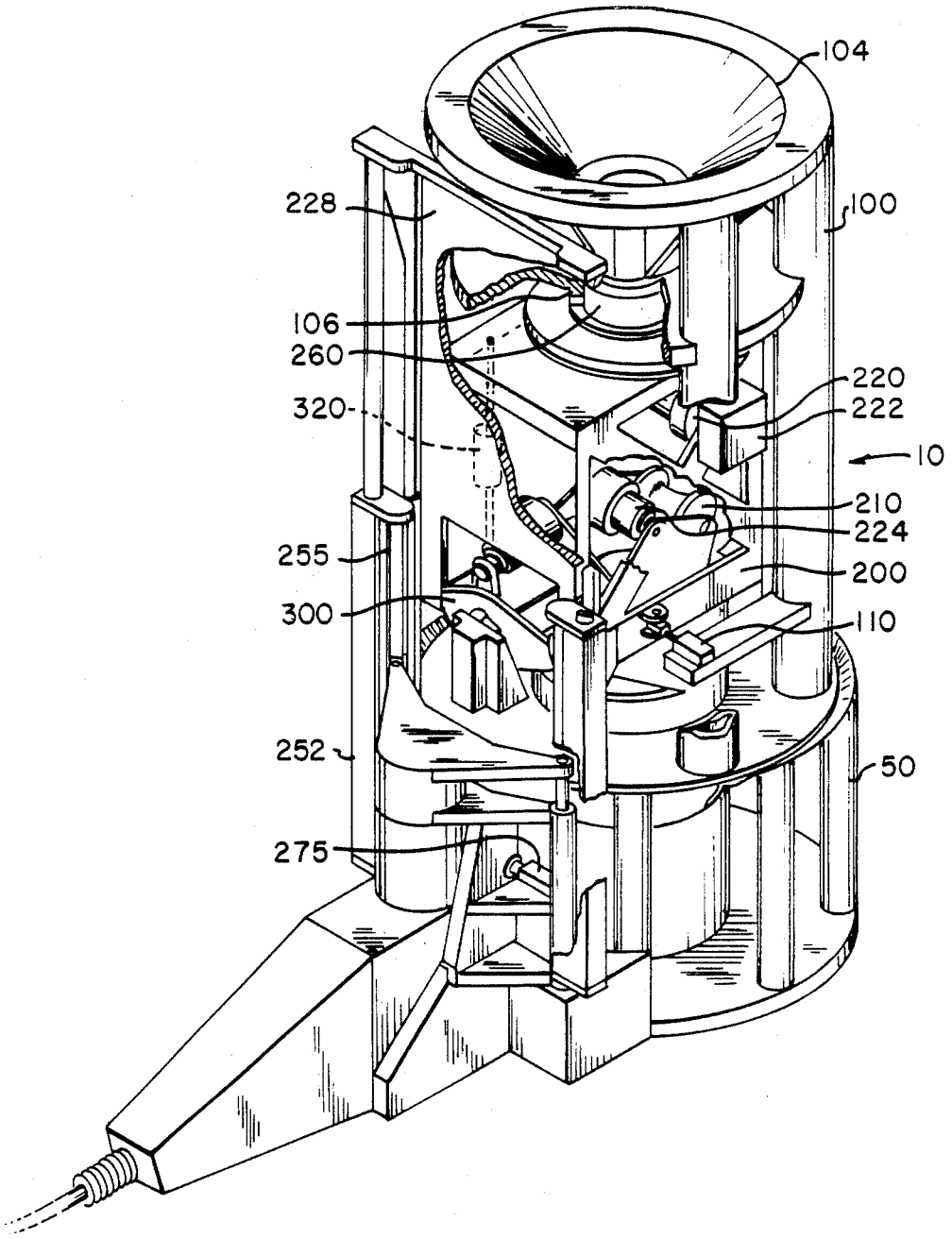
FIG. 1 is an isometric view of the pull in apparatus at the wellhead.

FIG. 1 is an isometric view of the pull in tool in place at the wellhead. The GRA 50 is shown in side elevation in FIG. 2 and is generally of the conventional type used for guidelineless reentry systems with the GRA 50 having wellhead 30 secured therein.

The GRA 50 guides into position tools, drill bits, casings, the BOP stack and the production equipment by means of its large diameter funnel 34. The GRA has two flow line receptacles 36 fabricated to it. The flow line receptacle provides structure to land and lock the flow line termination 400. Having two receptacles will balance the GRA during running operations. It will also provide an alternate receptacle for use if a circumstance arises where one receptacle is damaged.

The flow line termination is to be installed in either receptacle and locked in place. The hydraulic connector 102 on the bottom of the pull in tool is oriented by a lug on the tool engaging a slot in the GRA to align the pull in tool so that the flow line termination may be installed in the proper receptacle.

Figure 3:
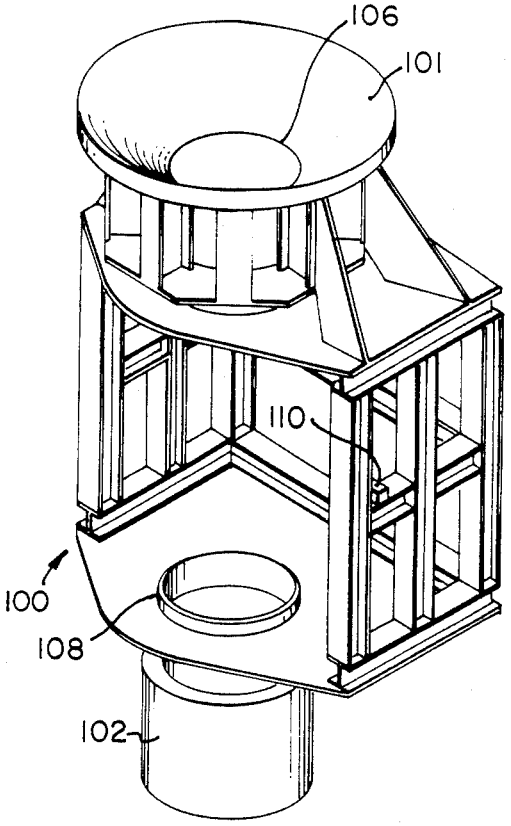
FIG. 3 is an isometric view of the pull in tool outer structure.
Figure 5:
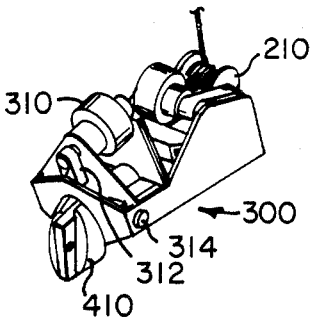
FIG. 5 is an isometric view of the pull in tool funnel assembly.

FIG. 3 illustrates the pull in tool outer structure 100. This differs in a few design detail respects from that shown in FIG. 1. The outer structure has the hydraulic connector 102 attached thereto for securing the outer structure of the pull in tool to the wellhead. The pull in tool is attached to the wellhead only during the pull in operation. After completion of this operation a production tree will be locked to the same wellhead.

The upper part of the outer structure 100 includes a reentry funnel 104 to allow a utility tool, which is used to run the pull in tool, to be reconnected subsea in the event of an emergency disconnect during the pull in operation. The upper section of the tool also provides the necessary control communication equipment.

The outer structure provides a rigid framework for attaching the pull in tool to the wellhead, and includes an upper bearing 106, and a lower bearing 108 to accept an inner structure which can be rotated around the vertical axis. It also carries a hydraulically operated cylinder 110, which may be actuated to rotate the inner structure with respect to the outer structure.

Figure 4:
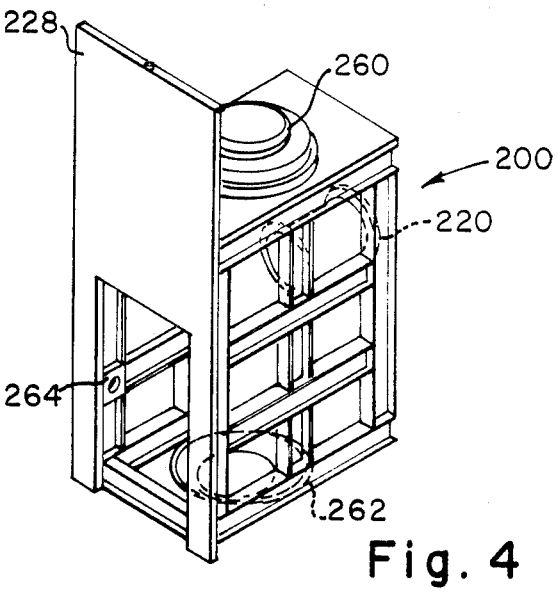
FIG. 4 is an isometric view of the pull in tool inner cage.

FIG. 4 illustrates the inner cage 200 which is rotatably mounted on bearings 106 and 108 within the outer structure. This cage houses a funnel assembly 300 mounted on pins 314 whereby this funnel assembly may be tilted vertically between +30° and −20° by hydraulic cylinders 320. The vertical orientation cylinder is manipulated by means of the hydraulic cylinders to follow the load of the pull in cable during the pull in operation. When the termination is secured to the funnel, the assembly is tilted to the −20° position to place the flow line mandrel in a vertical position.

The cage also includes a capstan 210 and a winch (which is also a cable take-up reel) 220. The capstan 210 provides the pull in of the cable. The capstan is mounted to the back of the funnel assembly and can be reversed to pay out cable. The cable take-up reel 220 (the drum winch), will take-up and store the cable pulled in by the capstan. This drum winch 220 also provides the back tension necessary to keep the cable tight on the capstan. Hydraulic motor 222 on the winch maintains a constant tension of the drum winch. The hydraulic motor 224 of the capstan is operated in either direction. In order to pay out the cable the capstan is reversed, and overcomes the constant tension of the drum winch, thereby pulling cable off the drum. This drum is intended to carry approximately 600 feet of one and a quarter inch diameter cable. The cable is initially stored on the take-up storage reel 220 and after making several passes around the capstan, is passed through the pull in funnel 300.

The inner cage also has a carriage assembly system 230 attached thereto. This provides for the vertical translation of the flow line termination to the GRA flow line receptacle after the line has been pulled in. It is comprised of a track system 231 and a carriage assembly 250. The track system mounted to this inner cage is actually a double track system. The outer rails 232 form a guide around plate 228 for the carriage assembly 250 to follow when lowering the tracks 255 and placing the rail extension alignment pins 254 in the GRA support structure track receptacles 38. The ends of the carriage assembly 250 ride inside the outer rails 255 using them as a track. The outer rails 255 are lowered into place by actuating hydraulic cylinder 252 thereby lowering the outer rails such that the lower end thereof fit within openings 38 in the GRA.

The carriage assembly 250 is lowered by actuating cylinders 257, being precisely guided by operating within tracks 255. This will carry down the flow line termination 400 placing pins 414 in notches 60. Pin 412 is used to lock the termination through hole 42 in the GRA.

As previously described, the inner cage 200 is rotatably mounted within the outer structure 100. Hydraulic cylinder 110 may be operated to rotate the inner structure plus or minus 20° around the vertical axis so that the pull in tool may follow the load of the pull in cable during the pull in operation. Bearings 260 and 262 fit within bearings 106 and 108 for this purpose. After the flow line termination is secured to the funnel the cylinders 110 may be activated to rotate the flow line termination to its final position.

The funnel assembly 300 has an inner sleeve (not shown) which locks onto the bullnose assembly 410 of the flow line termination in a conventional manner. Also, conventionally this inner sleeve is then stroked into the funnel by two large hydraulic cylinders securing the termination to the funnel face.

During this-stroking operation a keyed section 409 of the bullnose assembly engages a slotted sleeve in the funnel assembly. This slotted sleeve is then rotated by a rotary motor 310 until the flow line termination is in the correct vertical orientation. This rotary motor 310 coupled through a gear reducer drives a inner sleeve by means of a chain 312. The use of a chain greatly simplifies the manufacturing process as the tolerances required to have a direct gear interface would be extremely tight. The chain drive allows the flow line termination to be rotated a full 360° in either direction.

Pins 314 of the funnel assembly 300 pivotally mount this assembly within holes 264 of the inner cage 200. Hydraulic cylinder 320 is connected between the funnel assembly 300 and the inner cage 200, operating to rotate the assembly to the desired vertical orientation.

Figure 6:
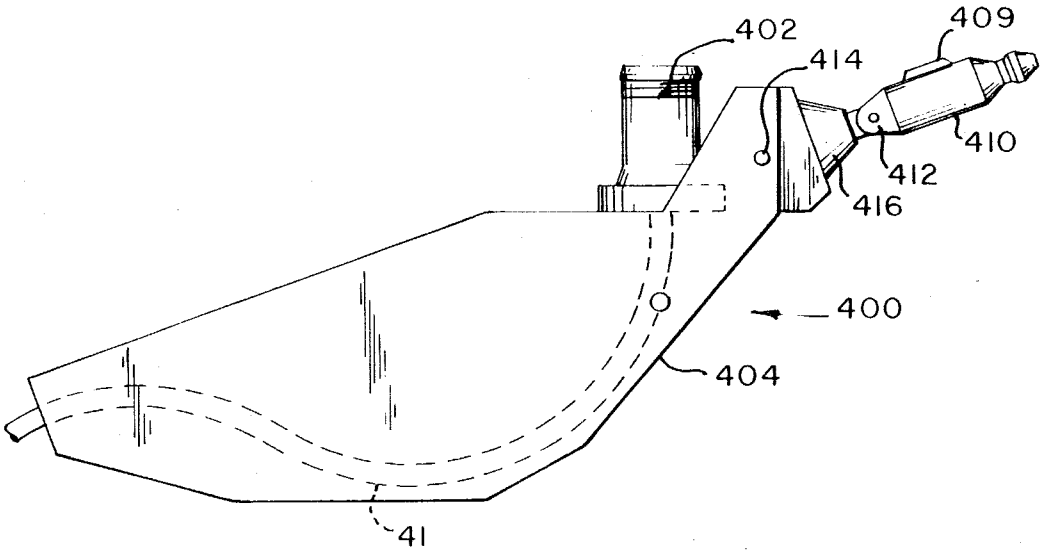
FIG. 6 is a side elevation of the flow line assembly termination assembly.

As illustrated in FIG. 6, the flow line termination 400 includes a flow line termination mandrel 402 mounted vertically on the termination structure 404. In a conventional manner, as usual with the flow line connectors, this termination may include an appropriate number of production lines as well as control lines and chemical injection lines.

The termination may also include electrical inductive couplers mounted vertically outboard of the mandrel in the termination structure. In this case a blanking cap 425 (FIG. 8), which would cover the mandrel during normal pull in operations, would carry an extension to protect the inductive couplers during the pull in operation.

The production lines 41 make a net 70° bend after passing vertically from the flow line mandrel, retaining a five foot minimum radius to permit "through the flow line" operations. They exit the flow line termination at this angle of 20° below horizontal, so that the lines reach the seabed floor at a reasonable distance thereby avoiding undue weight and bending loads on the system during operation.

The flow line structure 400 includes a pin 412 connecting bullnose 410 to attachment plate 416. This pin is located in line with the flow line leaving the structure. This provides for pulling in of the line by this pin in a direct line without placing bending on the flow line. Bullnose assembly 410 is secured to the flow line attachment plate 416 by this pin 412 passing through hole 418.

The pull in cable is attached to this bullnose prior to the pull in operation.

Referring to FIG. 14, the operation starts with the flow line termination 400 located on the pipe laying barge 16 with one end of the cable attached to bullnose 410. The cable 14 is passed to the drill ship and connected through the funnel assembly 300 around the capstan 210 and secured to the winch or cable take-up storage reel 220. A utility tool is made up to the pull in tool. The pull in tool is then lowered on drill pipe 20 simultaneously with the laying of the flow line bundle.

The GRA 50 has been located in the conventional manner and the pull in tool landed on the wellhead with the connector 102 being locked to the wellhead 30. TV cameras may be used for observation at this time.

Figure 7:
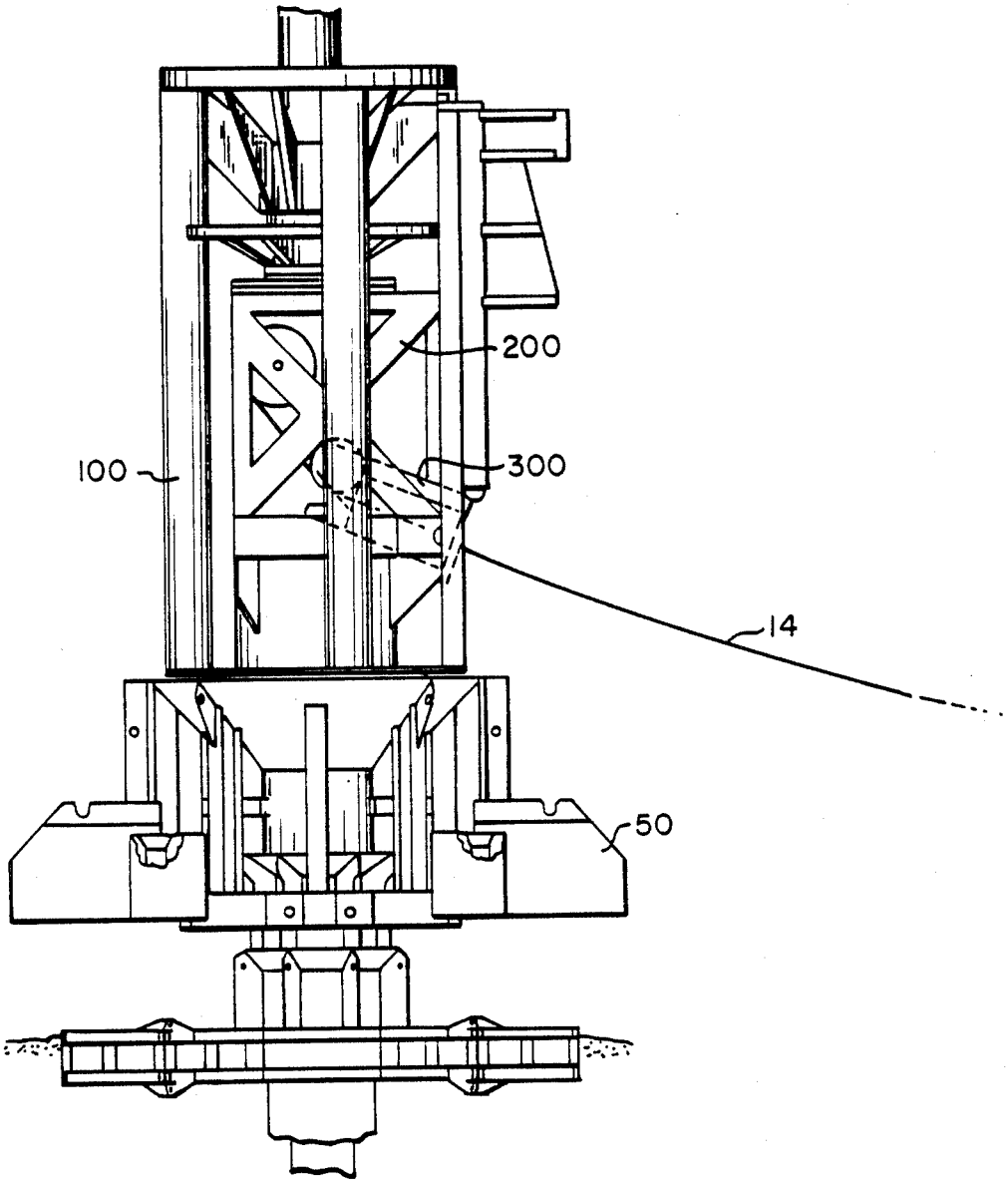
FIG. 7 shows a pull in tool landed and the pull in operation begun.

With the tool then as shown in FIG. 7, the funnel assembly 300 is aligned with the flow line termination and pull in cable by rotating the inner cage 200 around a vertical axis with respect to the outer cage 100. The funnel is tilted vertically by operating hydraulic cylinder 320, to the desired angle to follow the cable during the pull in operation.

Figure 8:
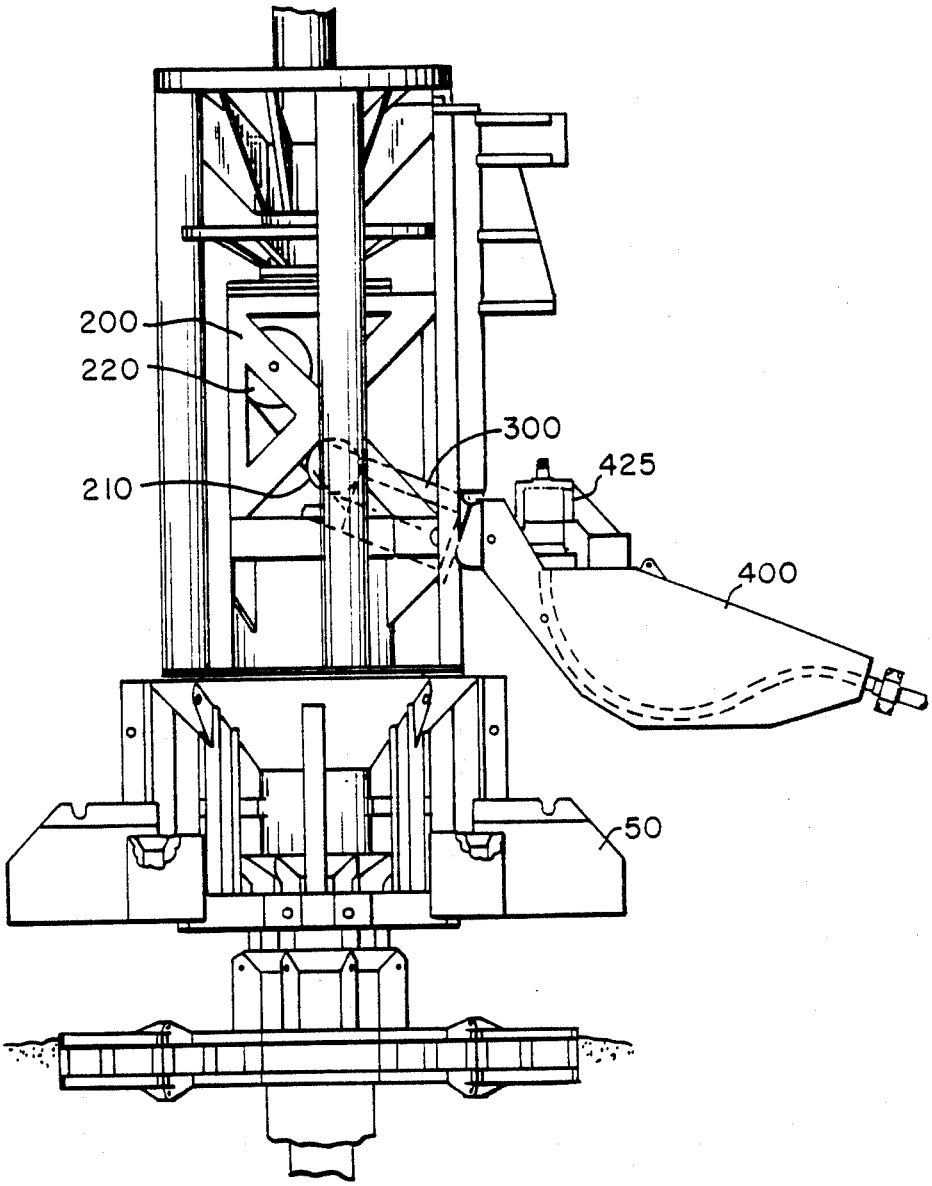
FIG. 8 shows the flow line termination pulled in to the funnel assembly and tilt cylinders actuated to horizontal alignment.

From the power source 22 located on the drill ship hydraulic fluid is passed through tubing to the capstan and drum winch motors and pull in of the cable 14 is started. This cable is pulled in until the bullnose 410 enters the funnel of the pull in tool funnel assembly 300 as shown in FIG. 8. The bullnose is locked inside the funnel by conventional means. The capstan 210 and drum winch 220 are then deactivated.

Hydraulic cylinders on the funnel assembly are stroked to pull the bullnose completely inside the funnel. This will also engage a keyed section of the bullnose into the slotted sleeve inside the funnel. The rotary motor 310 on the funnel is activated to rotate the slotted sleeve thus rotating the flow line termination to the correct vertical orientation. The inner structure 200, with funnel assembly 300, is then rotated around the vertical axis, by cylinder 110, to the desired final orientation. Thereafter, the funnel is tilted downwardly, by cylinder 320, carrying the termination to the proper vertical orientation.

Figure 9:
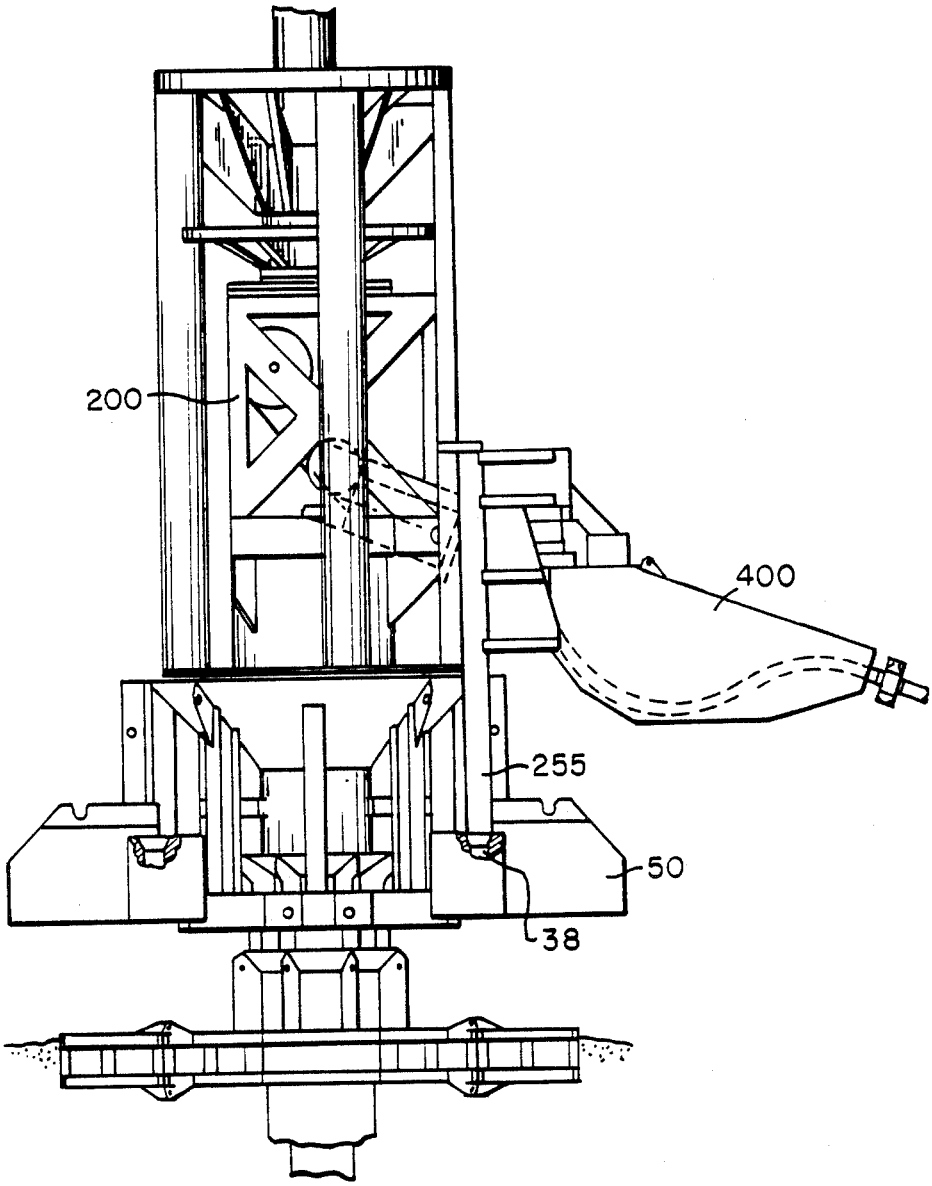
FIG. 9 shows the track assembly lowered into the guidelineless reentry assembly alignment receptacle and the flow line termination disengaged from the bullnose.

As shown in FIG. 9, the outside tracks 255 of the track assembly are lowered by activating the stroking cylinder 252 until the pins 254 of the outer track fit within track receptacles 38 of the GRA. These tracks may be easily aligned and passed into the receptacles since there is relatively low load on the apparatus at this time. The receptacles provide precise alignment when the tracks are inserted therein.

The carriage connector is locked onto the termination. Activating hydraulic cylinders 257 will drive the carriage assembly 250 down. The flow line termination 400 is carried with it. Hydraulic cylinder 275 is activated to shove pin 412 out of the bullnose and the cylinder then retracted. This disengages the flow line termination 400 from the funnel assembly 300.

Figure 10:
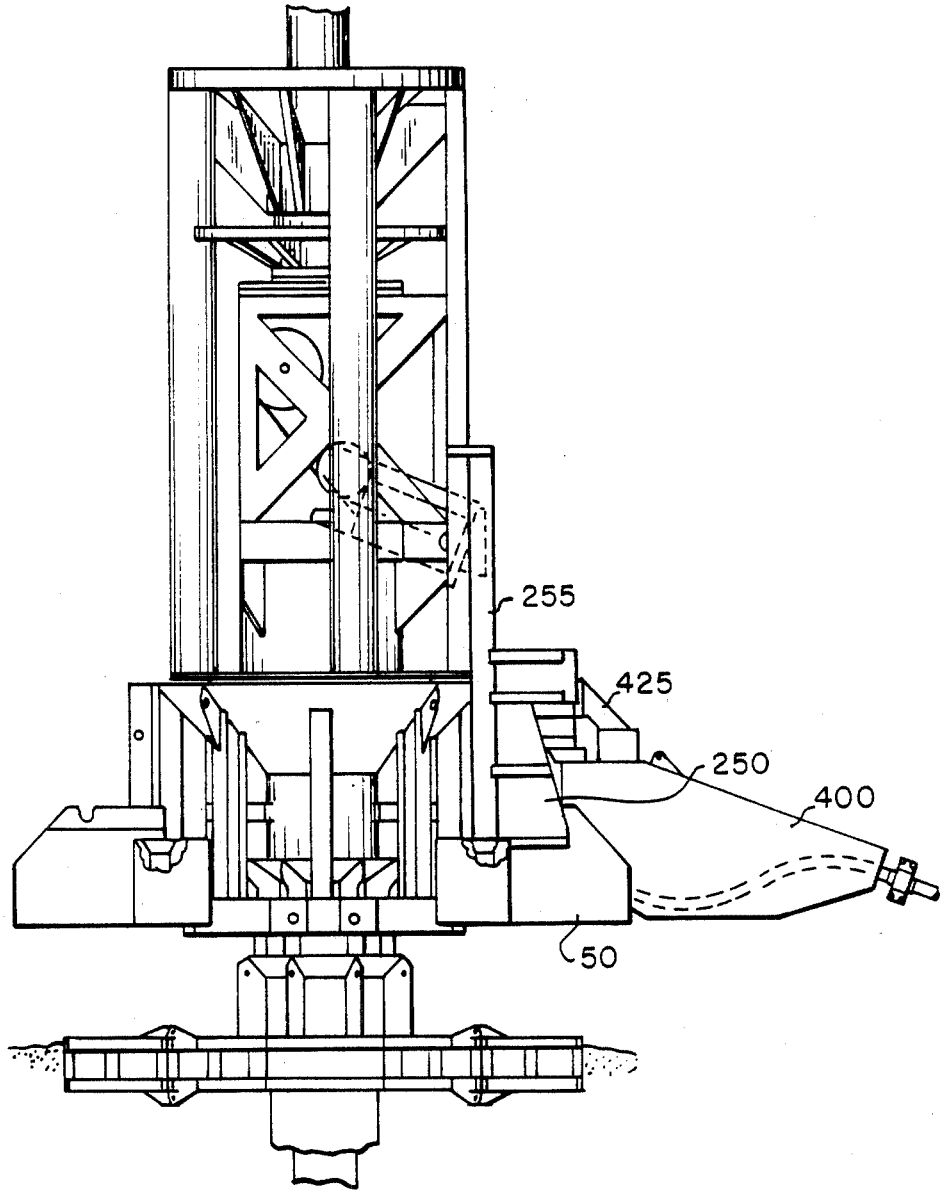
FIG. 10 shows the carriage assembly lowered with the flow line terminatlon landed and locked into the guidelineless reentry assembly.

The carriage assembly 250, riding on tracks 255, is lowered by activating hydraulic cylinder 252 to the position shown in FIG. 10. This carries to flow line termination 400 to the position where it is locked by pin 412 through hole 42 in the GRA.

Figure 11:
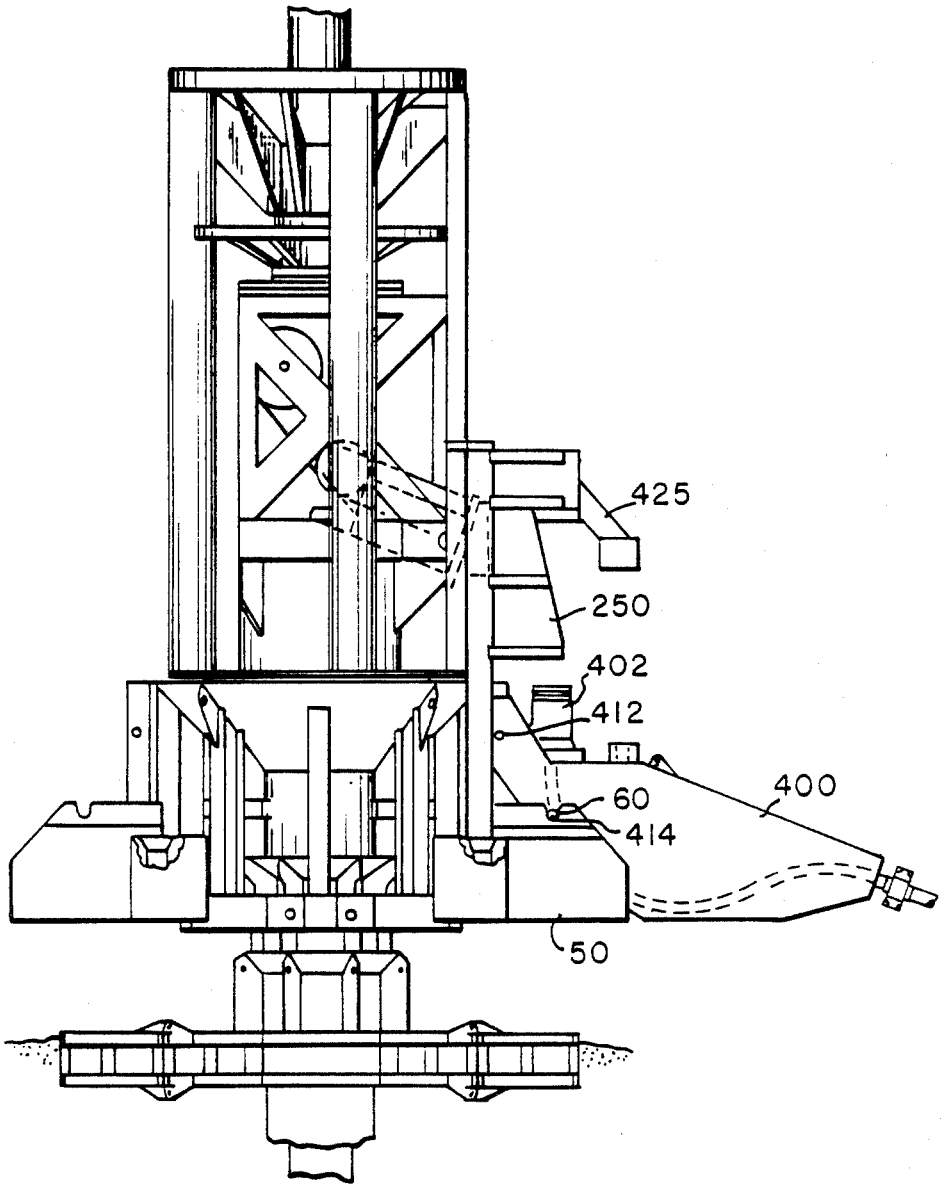
FIG. 11 shows the carriage assembly stroked up with the flow line terminal protective cover retrieved.

The blanking cap 425, if used, is unlocked (FIG. 11) and carried inside the carriage assembly 250.

Figure 12:
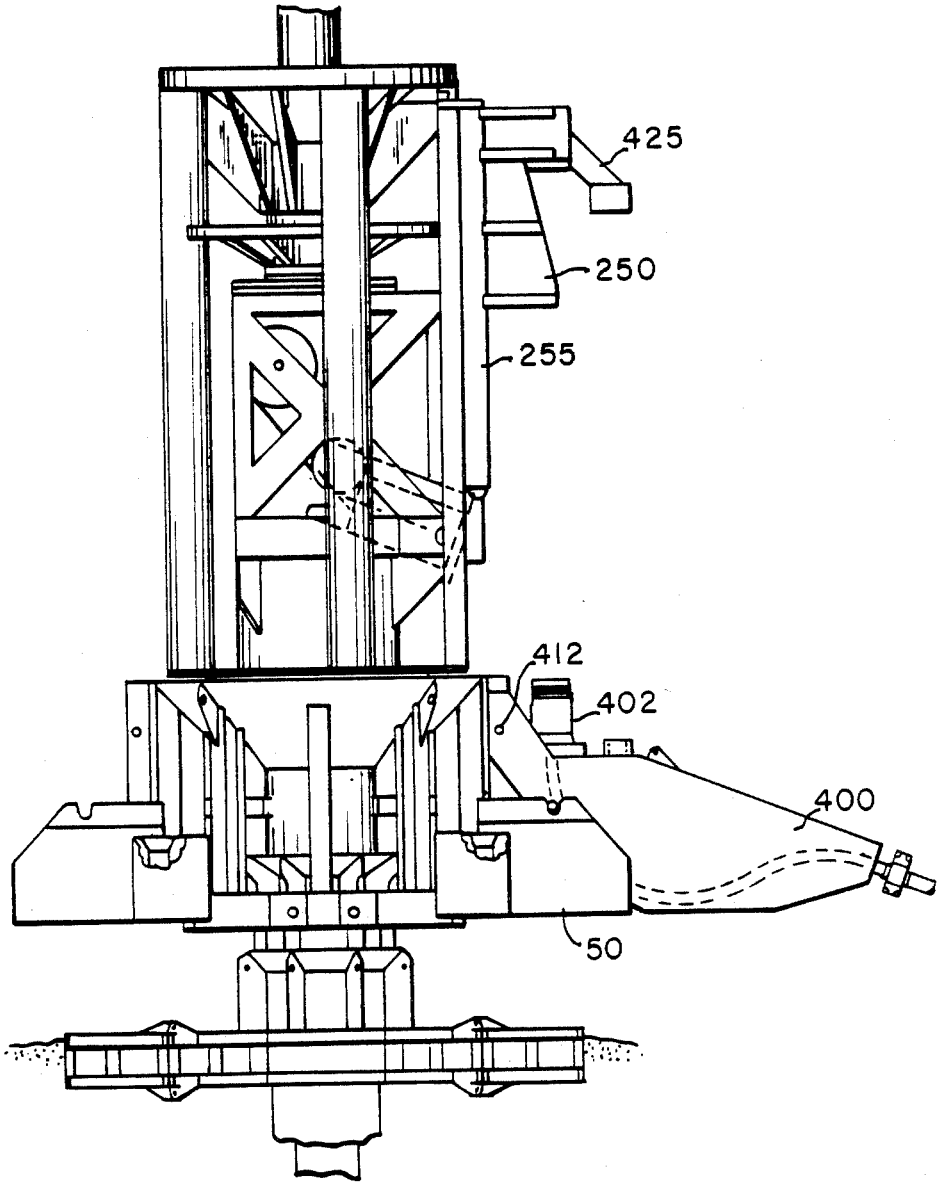
FIG. 12 shows the track assembly stroked up and the pull in tool unlocked from the wellhead.

The carriage assembly 250 is raised to its original position (shown in FIG. 12) leaving the flow line termination locked in place. The outer rails are then raised to the up position. Cylinder 257 raises the carriage, and cylinder 252 raises the track 255, further lifting the carriage.

The hydraulic connector 102 is then unlocked and the tool is retrieved to the drilling vessel leaving the structure behind as illustrated in FIG. 13.

Figure 15:
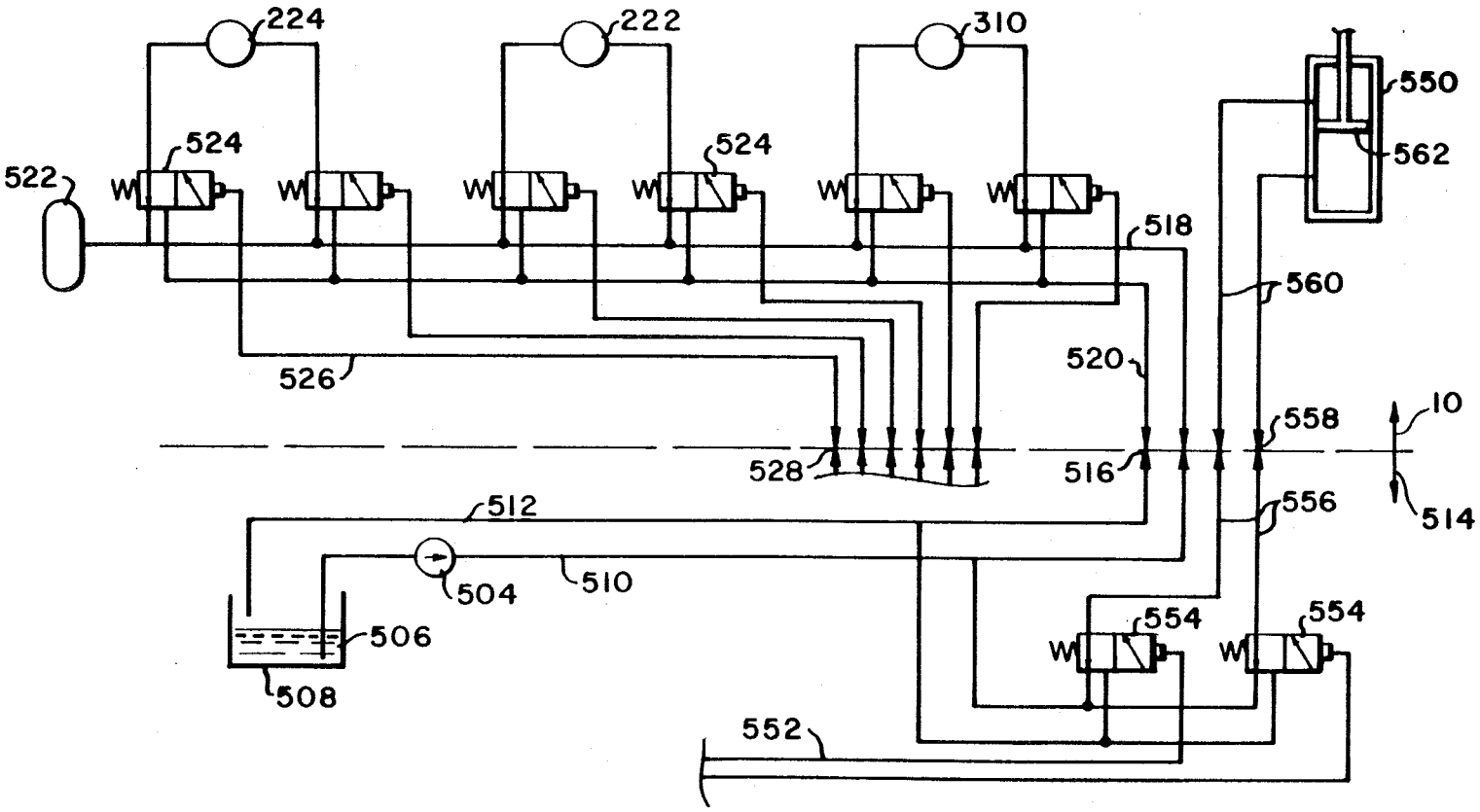
FIG. 15 is a schematic of the hydraulic actuating system.

FIG. 15 is a schematic drawing showing the application of conventional hydraulic equipment to the pull in tool. Pump 504 located on the drill ship takes hydraulic fluid 506 from sump 508. The fluid is delivered at high pressure through supply line 510, and returned at low pressure through vent line 512. It is conveyed to the utility tool 514, and by stab type connections 516 is passed to supply line 518 and vent line 520 in the pull in tool 10. Accumulator 522 minimizes pressure surges.

A plurality of spring loaded pilot valves 524 are operated by pilot lines 526 to direct the flow of hydraulic fluid to the various operators. Hydraulic motor 224, which operates the capstan 210, may thus be operated in either direction. Hydraulic motor 222 operating the drum winch 220, and hydraulic motor 310 rotating the funnel assembly operate in similar manner. Stab connections 528 connect the pilot lines 526 to the utility tool, so that the pilot valves may be operated from the surface.

Hydraulic cylinder 550 is typical of those used for the various locking and stroking functions. Pilot control lines 552 operate pilot valves 554 to direct the high pressure fluid supply and venting. The desired pressure is passed through lines 556 and stab connection 558 to lines 560. The pressure may be directed to a selected side of piston 562 and the other side vented. All the stroking operations may be carried out this way.

We claim:

1. A pull in tool for securing the end of a flow line at a predetermined location with respect to a subsea wellhead comprising:

an outer frame;

locking means for securing said outer frame to the wellhead;

an inner frame, rotatably mounted in said outer frame;

a winch carried by said inner frame;

a capstan carried by said inner frame;

a funnel assembly carried by said inner frame;

motor means attached to said winch for driving said winch;

power supply means connecting said motor means to a power supply at a surface location;

a flow line termination assembly secured to the flow line;

a mandrel secured to the end of the flow line;

a bullnose assembly detachably secured to said flow line termination; and a pull in cable fastened to said winch and capstan, passing through said funnel assembly and securable to said bullnose.

2. A pull in tool as in claim 1; said inner frame rotatable about a vertical axis.

3. A pull in tool as in claim 2; said funnel assembly pivotally mounted in said inner cage around a horizontal axis.

4. A flow line pull in apparatus for securing the end of a subsea flow line at a predetermined location with respect to a subsea wellhead comprising:

a permanent guide base associated with the wellhead, having alignment openings and locking openings therein;

a frame securable to the wellhead and substantially alignable with said guide base;

a double track assembly secured to said frame, and having a first and a second track;

a carriage assembly slidably mounted in said track assembly;

a flow line termination;

means for pulling said flow line termination into said carriage assembly;

means for moving said first of said tracks into aligning engagement with the alignment opening of said guide base;

means for moving said carriage assembly on said second track, and for carrying said flow line termination into a final position; and means for locking said flow line termination to the locking opening of said guide base in said final position.

5. A flow line pull in apparatus as in claim 4; said double track being vertically oriented.

6. A flow line pull in apparatus as in claim 5; said frame comprising an outer frame, and an inner frame rotatably mounted in said outer frame about a vertical axis.

* * * * *